US007657198B2

(12) United States Patent
Brockman et al.

(10) Patent No.: US 7,657,198 B2
(45) Date of Patent: Feb. 2, 2010

(54) METHODS FOR TRANSFERING TONER IN DIRECT TRANSFER IMAGE FORMING

(75) Inventors: Ryan David Brockman, Lexington, KY (US); Gregory Lawrence Ream, Lexington, KY (US); Pramod K. Sharma, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 590 days.

(21) Appl. No.: 11/566,831

(22) Filed: Dec. 5, 2006

(65) Prior Publication Data

US 2008/0131156 A1 Jun. 5, 2008

(51) Int. Cl.
*G03G 15/16* (2006.01)

(52) U.S. Cl. ..... 399/66; 399/314

(58) Field of Classification Search ..... 399/66, 399/314
See application file for complete search history.

(56) References Cited

U.S. PATENT DOCUMENTS 5,884,121 A * 3/1999 Kyung ..... 399/66
6,498,907 B2 * 12/2002 Yoda ..... 399/44

* cited by examiner

*Primary Examiner*—David M Gray
*Assistant Examiner*—G. M. Hyder

(57) ABSTRACT

The present application is directed to methods of controlling the transfer voltage in a transfer nip formed between the photoconductive member and the transfer member. The methods offset the effects of large transfer current spikes caused when a media sheet enters and exits the transfer nip. The control may include either ramping up or ramping down the transfer voltage. The ramped transfer voltage may include a series of alternating positive and negative steps that generally trend to ramp up or down. The size of the steps may further be adjusted to provide a smooth transition.

20 Claims, 10 Drawing Sheets

METHODS FOR TRANSFERING TONER IN DIRECT TRANSFER IMAGE FORMING

BACKGROUND

The present application is directed to adjusting one or more operating parameters for toner transfer in a direct transfer image forming apparatus and, more particularly, to methods of transfer voltage control to prevent print defects.

Certain image forming devices use an electrophotographic imaging process to develop toner images on a media sheet. The electrophotographic process uses electrostatic voltage differentials to promote the transfer of toner from component to component. For example, a voltage vector may exist between a developer roll and a latent image on a photoconductive member. This voltage vector helps promote the transfer of toner from the developer roll to the latent image in a process that is sometimes called "developing the image." A separate voltage vector may exist within a transfer nip formed between the photoconductive member and a transfer member to promote the transfer of a developed image onto a media sheet. In each instance, the toner transfer occurs in part because the toner itself is charged and is attracted to surfaces having an opposite charge or a lower potential.

In a direct transfer system where toner is moved directly from the photoconductive member to the media sheet, current flow between the transfer member and the photoconductive member may produce an undesirable charge on the photoconductive member. A non-uniform current may be produced on the photoconductive member when a leading edge of the media sheet enters into the transfer nip formed between the photoconductive member and the transfer member. The entering media sheet causes a large negative spike in the current that occurs because the current path between the photoconductive member and transfer member is momentarily disrupted. A non-uniform current may also be produced when the trailing edge of the media sheet exits the transfer nip. The exiting media sheet causes a large negative spike in the current that occurs because the current path between the photoconductive member and transfer member is momentarily disrupted. Once the media sheet exits the transfer nip, contact with the photoconductive member is reestablished and a large positive current spike occurs due to the excess charge that has built up and is released.

The current should be controlled with excessive spikes in the positive or negative direction limited to prevent the occurrence of print defects. If not controlled, a negative spike in the transfer current may result as a light band due to a relative over-charging of the photoconductive member. A positive spike may appear as a dark band where the photoconductive member is discharged and cannot be fully recharged.

SUMMARY

The present application is directed to methods of controlling the transfer voltage in a transfer nip formed between the photoconductive member and the transfer member. The methods offset the effects of large transfer current spikes caused when a media sheet enters and exits the transfer nip. The control may include either ramping up or ramping down the transfer voltage. The ramped transfer voltage may include a series of alternating positive and negative steps that generally trend to ramp up or down. The size of the steps may further be adjusted to provide a smooth transition.

DETAILED DESCRIPTION

Figure 1:
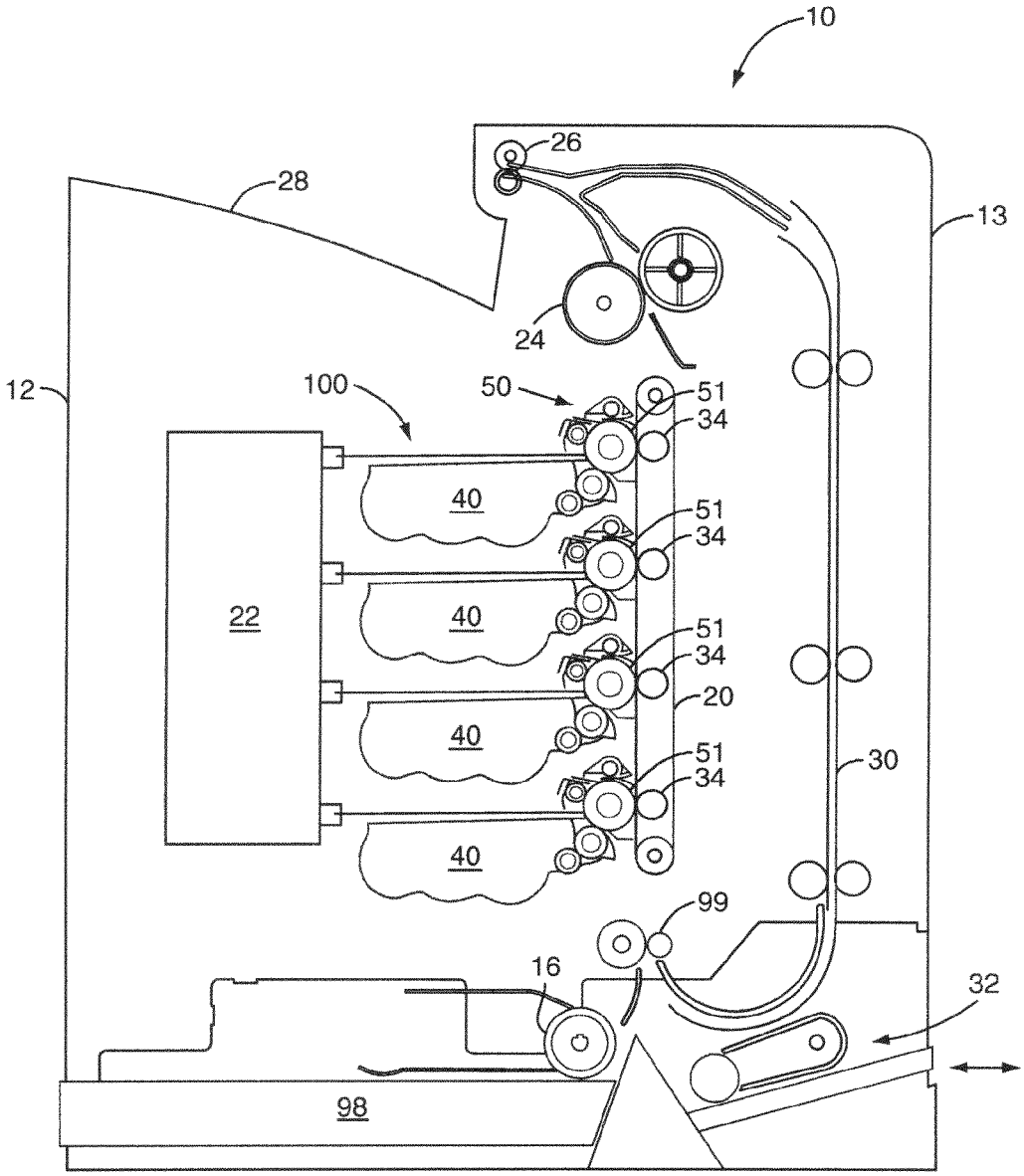
FIG. 1 is a schematic view of an image forming device according to one embodiment.

Embodiments disclosed herein are directed to devices and related methods to control the transfer voltage in a transfer nip to compensate large transfer current spikes when media sheets enter into and exit from the transfer nip. These embodiments may be applicable in a device that uses an electrophotographic imaging process such as the representative image forming device 10 shown in FIG. 1. The exemplary image forming device 10 comprises a main body 12 and a door assembly 13. A media tray 98 with a pick mechanism 16, and a multi-purpose feeder 32, are conduits for introducing media sheets 90 into the device 10. The media tray 98 is preferably removable for refilling, and located on a lower section of the device 10.

Media sheets 90 are moved from the input and fed into a primary media path. One or more registration rollers 99 disposed along the media path aligns the media sheets 90 and precisely controls its further movement along the media path. A media transport belt 20 forms a section of the media path for moving the media sheets 90 past a plurality of image forming units 100. Color printers typically include four image forming units 100 for printing with cyan, magenta, yellow, and black toner to produce a four-color image on the media sheet 90.

An optical scanning device 22 forms a latent image on a photoconductive member 51 within the image forming units 100. The media sheet 90 with loose toner is then moved through a fuser 24 to fix the toner to the media sheet 90. Exit rollers 26 rotate in a forward direction to move the media sheet 90 to an output tray 28, or rollers 26 rotate in a reverse direction to move the media sheet 90 to a duplex path 30. The duplex path 30 directs the inverted media sheet 90 back through the image formation process for forming an image on a second side of the media sheet 90.

Figure 2:
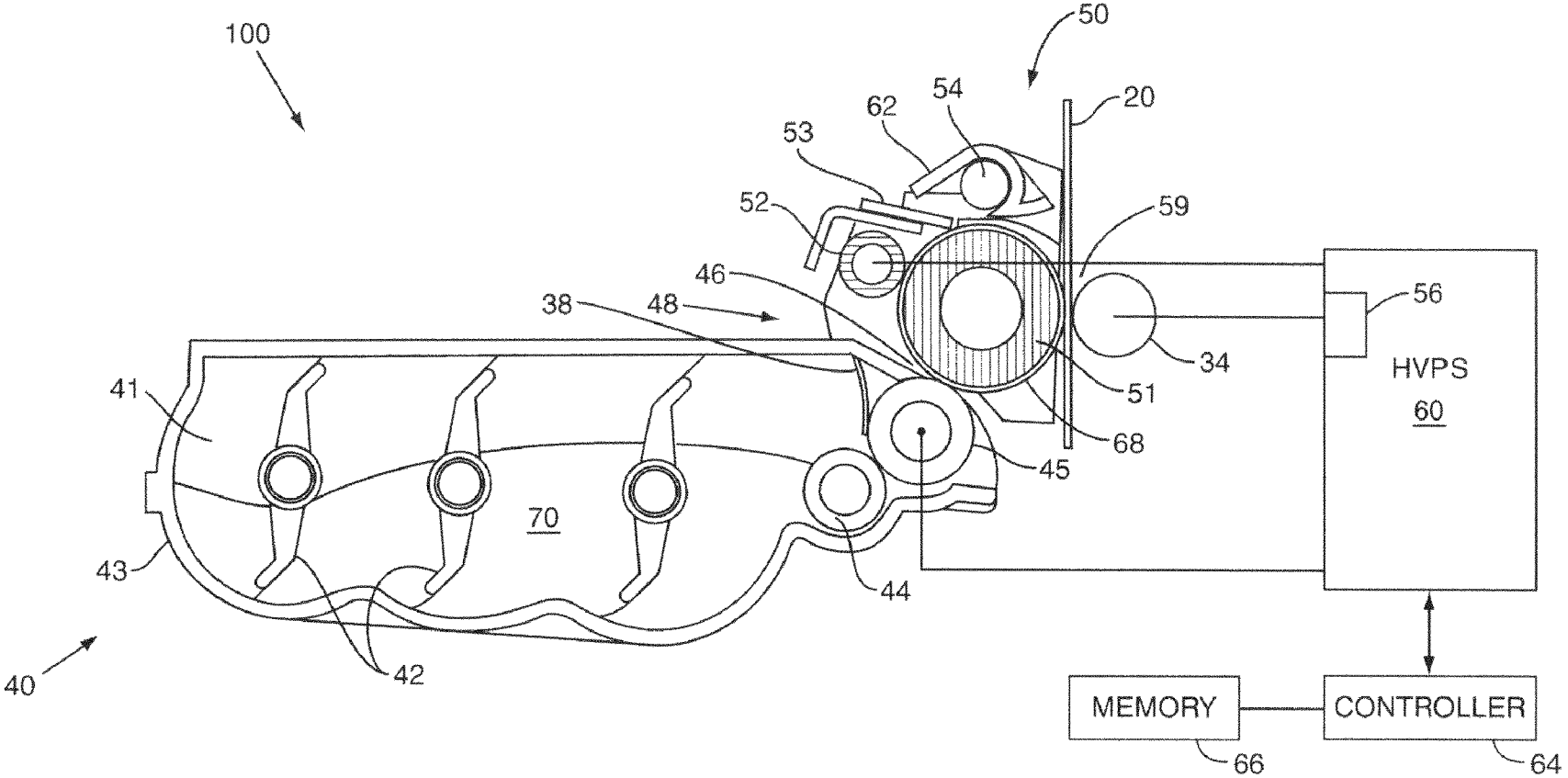
FIG. 2 is a cross-sectional view of an image forming unit and associated power supply according to one embodiment.

As illustrated in FIGS. 1 and 2, the image forming units 100 are comprised of a developer unit 40 and a photoconductor (PC) unit 50. The developer unit 40 comprises an exterior housing 43 that forms a reservoir 41 for holding a supply of toner 70. One or more agitating members 42 are positioned within the reservoir 41 for agitating and moving the toner 70 towards a toner adding roll 44 and the developer member 45. The developer unit 40 further comprises a doctor element 38 that controls the toner 70 layer formed on the developer member 45. In one embodiment, a cantilevered, flexible doctor blade as shown in FIG. 2 may be used. Other types of doctor elements 38, such as spring-loaded, ingot style doctor elements may be used. The developer unit 40 and PC unit 50 are structured so the developer member 45 is accessible for contact with the photoconductive member 51 at a nip 46. Consequently, the developer member 45 is positioned to develop latent images formed on the photoconductive member 51.

The exemplary PC unit 50 comprises the photoconductive member 51, a charge roller 52, a cleaner blade 53, and a waste toner auger 54 each disposed within a housing 62 that is separate from the developer unit housing 43. In one embodiment, the photoconductive member 51 is an aluminum hollow-core drum with a photoconductive coating 68 comprising one or more layers of light-sensitive organic photoconductive materials. The photoconductive member 51 is mounted protruding from the PC unit 50 to contact the developer member 45 at nip 46. Charge roller 52 is electrified to a predetermined bias by a high voltage power supply (HVPS) 60 that is adjusted or turned on and off by a controller 64. The charge roller 52 applies an electrical charge to the photoconductive coating 68. During image creation, selected portions of the photoconductive coating 68 are exposed to optical energy, such as laser light, through aperture 48. Exposing areas of the photoconductive coating 68 in this manner creates a discharged latent image on the photoconductive member 51. That is, the latent image is discharged to a lower charge level than areas of the photoconductive coating 68 that are not illuminated.

The developer member 45 (and hence, the toner 70 thereon) is charged to a bias level by the HVPS 60 that is advantageously set between the bias level of charge roller 52 and the discharged latent image. In one embodiment, the developer member 45 is comprised of a resilient (e.g., foam or rubber) roller disposed around a conductive axial shaft. Other compliant and rigid roller-type developer members 45 as are known in the art may be used. Charged toner 70 is carried by the developer member 45 to the latent image formed on the photoconductive coating 68. As a result of the imposed bias differences, the toner 70 is attracted to the latent image and repelled from the remaining, higher charged portions of the photoconductive coating 68. At this point in the image creation process, the latent image is said to be developed.

The developed image is subsequently transferred to a media sheet 90 being carried past the photoconductive member 51 by media transport belt 20. In the exemplary embodiment, a transfer member 34 is disposed behind the transport belt 20 in a position to impart a contact pressure at a transfer nip 59. In addition, the transfer member 34 is advantageously charged, typically to a polarity that is opposite the charged toner 70 and charged photoconductive member 51 to promote the transfer of the developed image to the media sheet 90.

In one embodiment, the charge roller 52, the photoconductive member 51, the developer member 45, the doctor element 38 and the toner adding roll 44 are all negatively biased. The transfer member 34 may be positively biased to promote transfer of negatively charged toner 70 particles to a media sheet 90. Those skilled in the art will comprehend that an image forming unit 100 may implement polarities opposite from these.

A controller 64 may control the operating parameters of the imaging elements. The controller 64 may adjust the parameters based on feedback from one or more detection measures. In one embodiment, controller 64 sets the operating parameters based on stored values maintained in memory 66. In one embodiment, a transfer servo voltage that produces a predetermined current through the transfer roller 34 is determined. More specifically, the HVPS 60 includes a sensing circuit 56 adapted to sense the voltage transmitted to the transfer roller 34 that produces the target current. Periodically, the HVPS 60, under the control of controller 64, implements a transfer servo routine to determine the transfer servo voltage that varies in relation to changing operating conditions. The printer controller 64 may adjust operating parameters (e.g., bias voltage applied to the transfer roller 34 or the fuser 24 shown in FIG. 1) based on the determined transfer servo voltage to compensate for changes in operating conditions such as the media sheet 90 entering or exiting the transfer nip.

Figure 3A:
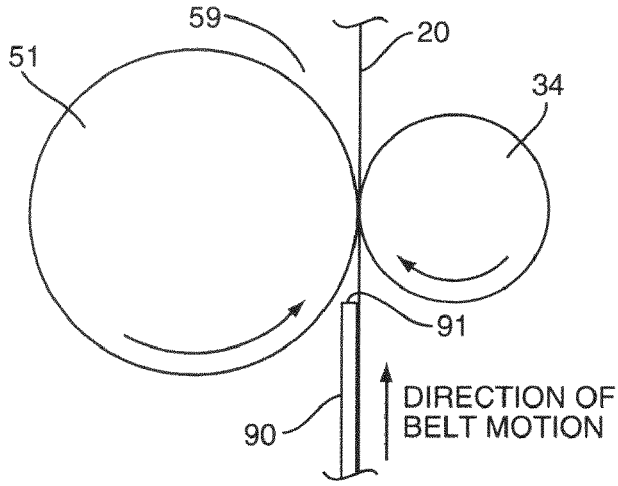
FIG. 3A is a schematic view of a media sheet approaching a transfer nip according to one embodiment.
Figure 3B:
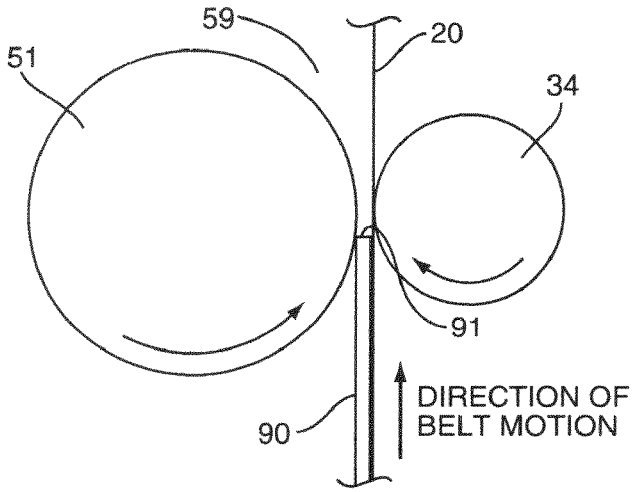
FIG. 3B is a schematic view of a leading edge of the media sheet entering into the transfer nip according to one embodiment.
Figure 3C:
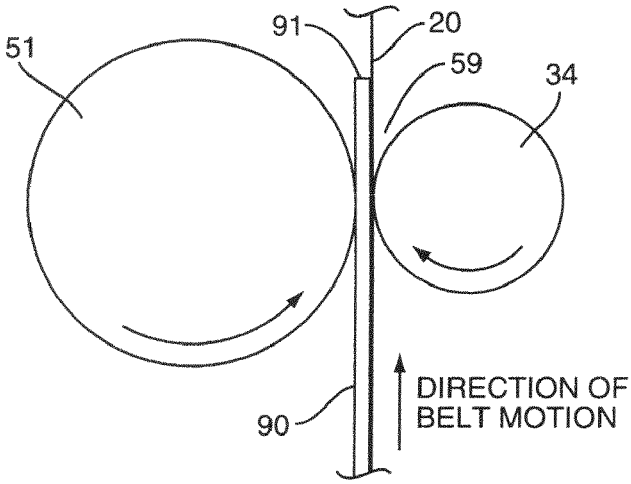
FIG. 3C is a schematic view of the leading edge of the media sheet having passed beyond the transfer nip according to one embodiment.

FIGS. 3A-3C illustrate a media sheet 90 moving along the media path and into the transfer nip 59 formed between the photoconductive member 51 and the transfer member 34. FIG. 3A illustrates the leading edge 91 of the media sheet 90 upstream from the transfer nip 59. FIG. 3B illustrates the leading edge 91 within the transfer nip 59. FIG. 3C illustrates the leading edge 91 having moved through the transfer nip 59 with the remainder of the media sheet moving through the nip 59.

Figure 4:
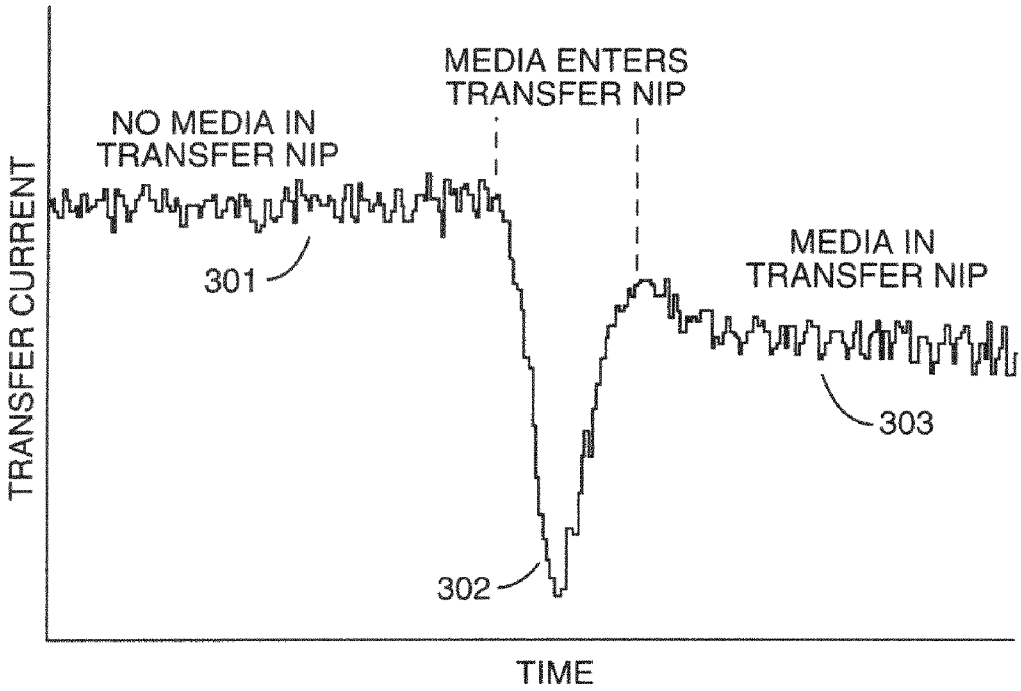
FIG. 4 is a graph illustrating the transfer current for the time the leading edge of the media sheet approaches and passes through a transfer nip according to one embodiment.

FIG. 4 illustrates the change in transfer current as the media sheet 90 moves into the transfer nip 59 assuming a substantially constant transfer voltage. The transfer current is substantially constant for a time period 301 prior to the leading edge 91 entering into the transfer nip 59. Time period 301 corresponds to FIG. 3A with the media sheet 90 being upstream from the transfer nip 59. The transfer current then experiences a large negative spike 302 (or current drop) caused by a momentary disruption in the current path between the transfer member 34 and the photoconductive member 51. The spike 302 occurs as the leading edge 91 enters into the transfer nip 59 as illustrated in FIG. 3B. The transfer current then returns to a substantially constant level 303 after the leading edge 91 has moved through the transfer nip 59. This corresponds to FIG. 3C with the media sheet 90 within the transfer nip 59 to receive the toner image from the photoconductive member 51. In this embodiment, the transfer current is lower in the period 303 with the media sheet 90 within the transfer nip 59 than the period 301 prior to entering into the transfer nip 59. This lower transfer current during period 303 is due in part to the relatively high resistance of the media sheet 90.

Figure 5A:
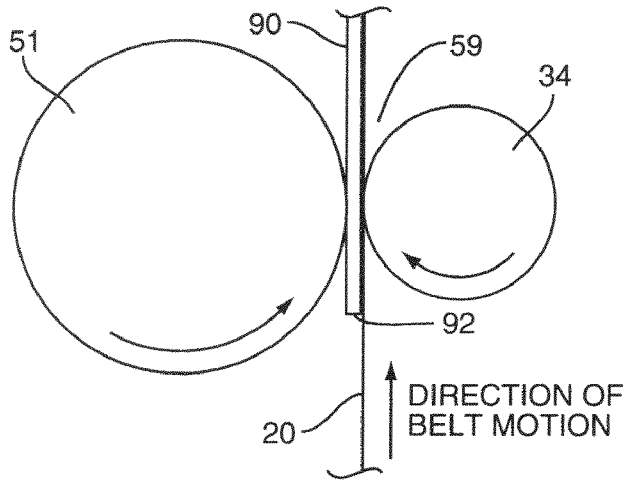
FIG. 5A is a schematic view of a trailing edge of a media sheet approaching a transfer nip according to one embodiment.
Figure 5B:
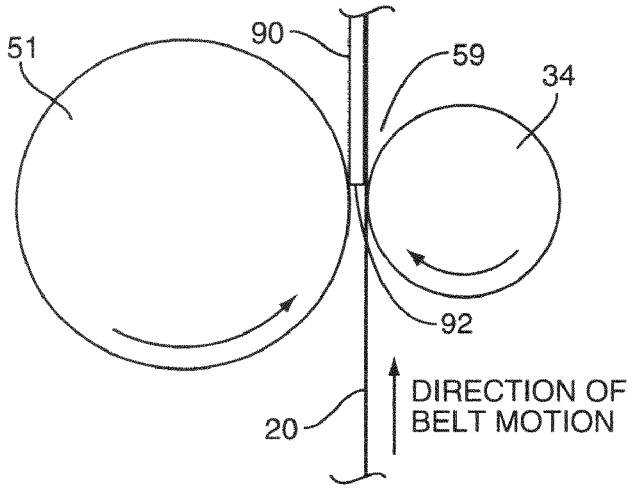
FIG. 5B is a schematic view of the trailing edge of the media sheet entering into the transfer nip according to one embodiment.
Figure 5C:
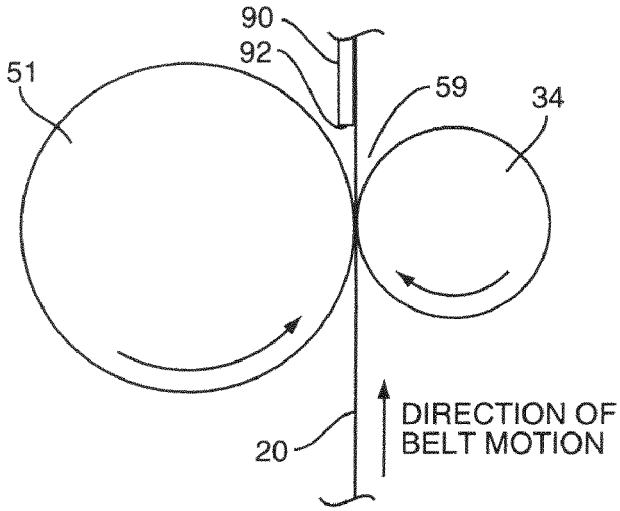
FIG. 5C is a schematic view of the media sheet moving away from the transfer nip according to one embodiment.

FIGS. 5A-5C illustrate a trailing edge 92 of the media sheet 90 moving through the transfer nip 59. FIG. 5A illustrates the media sheet 90 within the transfer nip 59 during image transfer with the trailing edge 92 upstream from the transfer nip 59. FIG. 5B illustrates the trailing edge 92 moving through the transfer nip 59 as the media sheet 90 exits. FIG. 5C illustrates the trailing edge 92 having passed through the transfer nip 59 and the media sheet 90 moving away from the photoconductive member 51 and the transfer member 34

Figure 6:
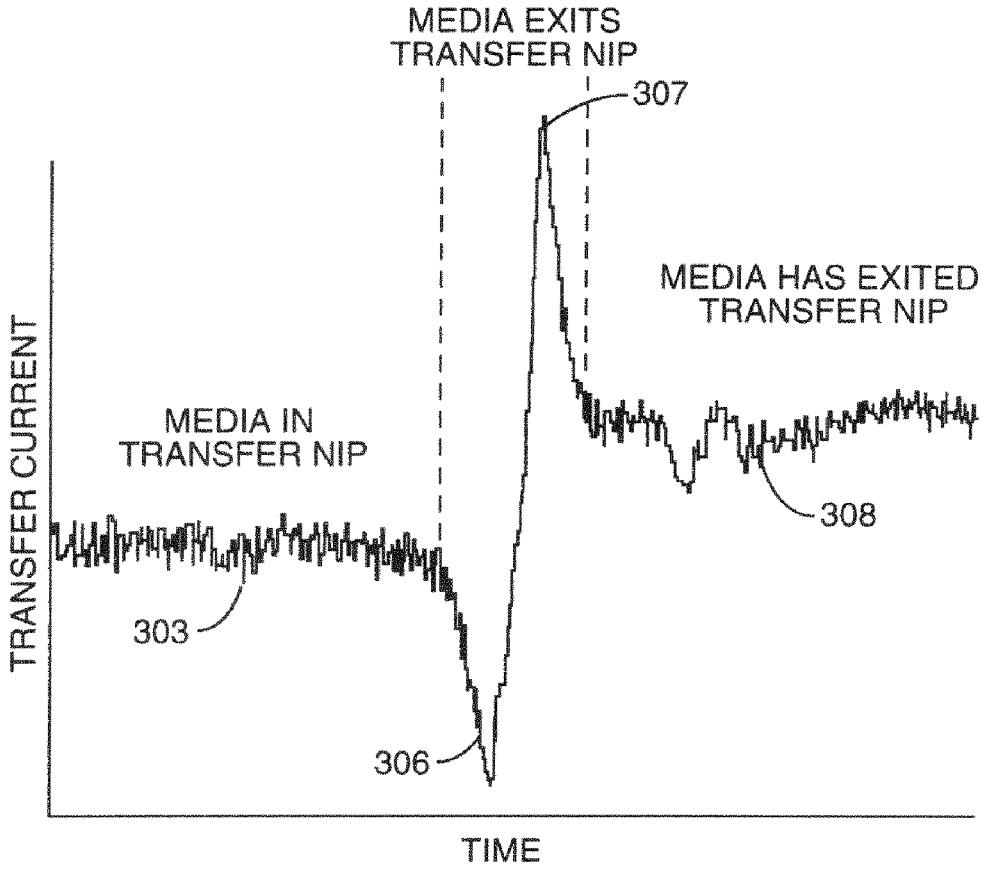
FIG. 6 is a graph illustrating the transfer current for the time the trailing edge of the media sheet approaches and passes through a transfer nip according to one embodiment.

FIG. 6 illustrates the change in the transfer current as the media sheet 90 exits from the transfer nip 59. Period 303 when the media sheet 90 is moving through the transfer nip 59 results in a substantially constant transfer current. This corresponds to the events illustrated in FIG. 5A. Exit of the media sheet 90 from the transfer nip 59 initially causes a negative spike 306 in the transfer current followed by a positive spike 307. As above, the negative spike 306 is caused by a momentary disruption in the current path between the transfer member 34 and the photoconductive member 51. The large positive spike 307 in the transfer current occurs due to an excess charge that builds up as the current path is disrupted while the media sheet 90 exits the transfer nip 59. Once the trailing edge 92 exits the nip 59, the current path is reestablished thus releasing the excess charge. This situation is illustrated in FIG. 5B. The transfer current then returns to a substantially constant level 308 after the trailing edge 92 passes beyond the transfer nip 59 as illustrated in FIG. 5C.

These current spikes caused by the entering and exiting of the media sheet 90 relative to the transfer nip 59 produce predictable changes on the charge of the photoconductive member 51. Transfer voltage ramps may be used while the media sheet 90 is entering or exiting the transfer nip to counteract the charge caused by the spikes. Embodiments of a ramped transition are described in U.S. Pat. No. 5,697,015 herein incorporated by reference.

In some instances, a simple ramp is adequate to counteract the effects of the media sheet 90 entering and exiting the transfer nip 59. However, the requirements for the ramp steps may be so large that they discharge the photoconductive member 51 too much or exceed the limits of the HVPS 60. Therefore, the ramp should be arranged with alternating positive steps 121 and negative steps 122. The alternating steps 121, 122 keep the photoconductive member 51 from being overcharged with either polarity. Additionally, dropping the voltage between positive steps 121 prevents reaching the limit of the HVPS 60. If the HVPS limit is approached with a positive step 121, the voltage is decreased in a negative step 122 thus providing capacity for increase in a subsequent positive step 121.

Figure 7:
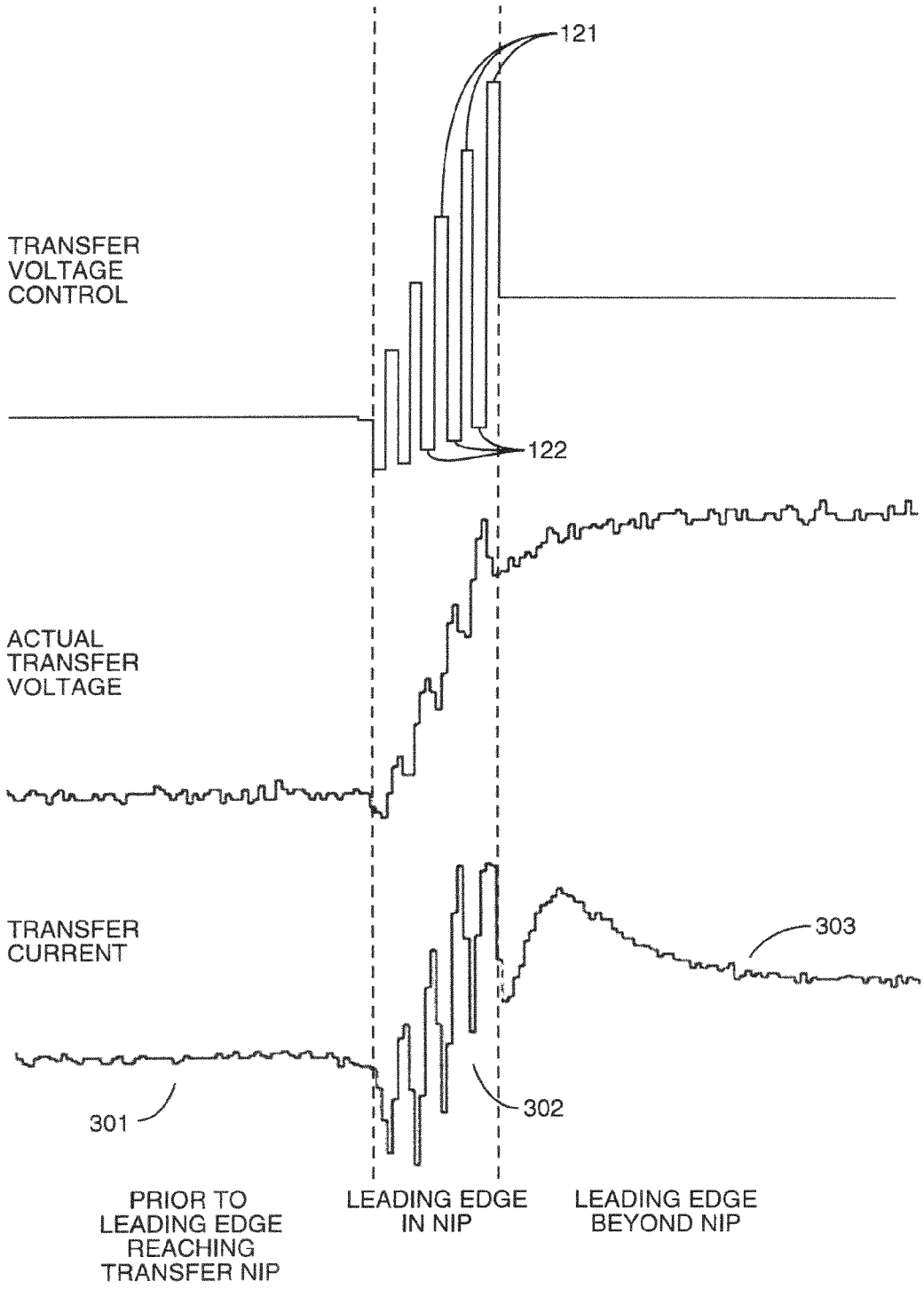
FIG. 7 illustrates a graph of the transfer voltage control and resulting transfer voltage and transfer current as a media sheet approaches and passes through a transfer nip according to one embodiment.

FIG. 7 illustrates one embodiment of the alternating steps of the transfer voltage control established by the controller 64 to compensate for the media sheet 90 entering into the transfer nip 59. Each positive step 121 is directly followed by a corresponding negative step 122. Each of the positive steps 121 is progressively larger causing the overall transfer voltage control to trend upward to form a positive spike to offset the corresponding negative transfer current spike (See FIG. 4). These transfer voltage control steps 121, 122 result in a corresponding overall increase in the actual transfer voltage. As illustrated with the transfer current, positive and negative current spikes are generated at each step.

Figure 8:
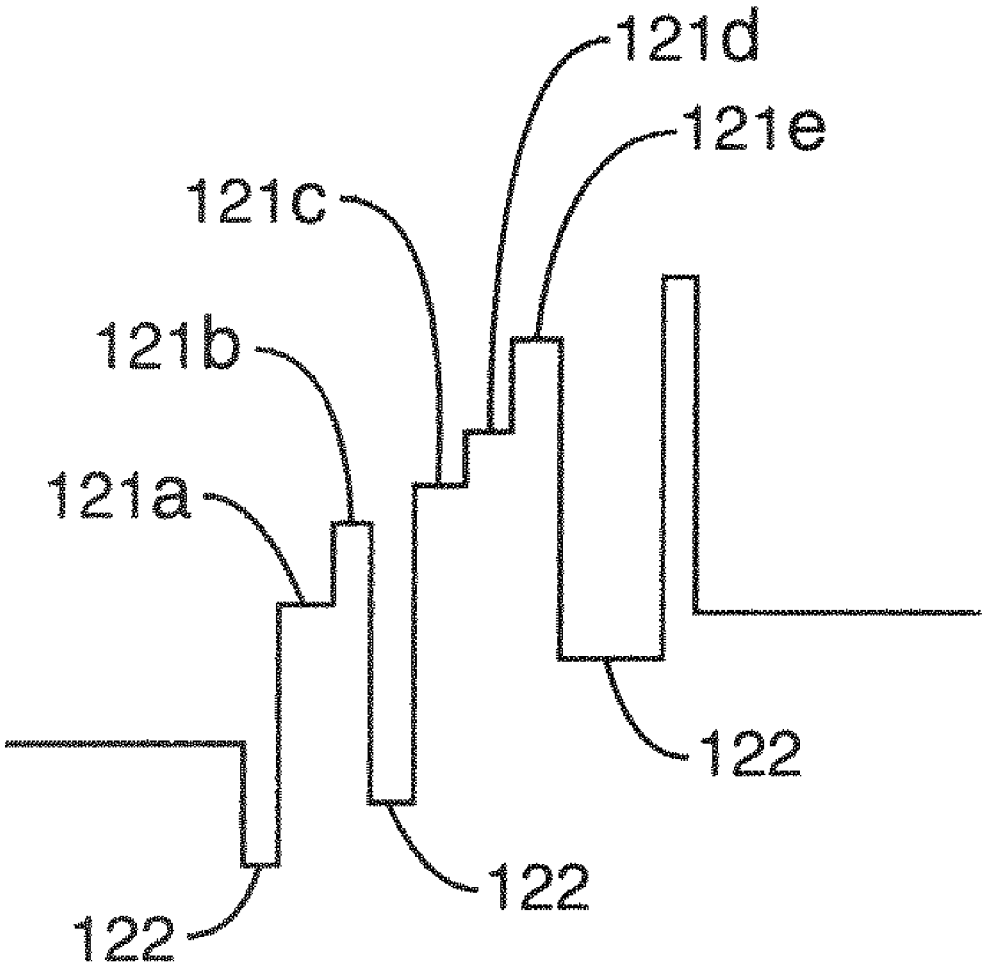
FIG. 8 illustrates a graph of the transfer voltage control according to one embodiment.

The embodiment of FIG. 7 includes a transfer voltage control with each positive step 121 followed immediately by a negative step 122. In another embodiment, the positive and negative steps 121, 122 may not be immediately adjacent to one another. FIG. 8 illustrates an embodiment with multiple positive spikes 121 grouped together between negative steps 122. Specifically, positive spikes 121*a* and 121*b* are grouped together as are steps 121*c*, 121*d*, and 121*e*.

Various methods may be used by the controller 64 to determine the size of the positive steps 121. One embodiment includes determining the difference between the transfer voltage during image formation and the non-image formation transfer voltage when no media sheet 90 is within the transfer nip 90. The difference in voltages is then divided into substantially equal steps to create a gradual transition between image formation and non-image formation transfer voltages. The steps may establish a nominal voltage level at discrete points between the image and non-image transfer voltages. In other words, the steps may establish a DC component to the ramped voltage. The amplitude (or AC component) of the alternating voltage may be fixed or variable. In one embodiment such as that shown in FIG. 7, the amplitude may increase in size during the transition. In one embodiment, the amplitude may decrease in size during the transition.

Another embodiment uses the transfer servo voltage. As explained above, the transfer servo voltage is that voltage applied to the transfer member 34 that causes a specific amount of current to flow through the transfer system. The transfer servo voltage is determined periodically and corresponds to various operating parameters. For example, operating parameters such as a transfer voltage ramp profile may be stored in memory 66 and accessed once the transfer servo routine is completed. Because the transfer servo method is a measure of the resistance of the transfer system, using the transfer servo voltage to determine the step size and amplitude may provide better control over the amount of charge being sent to the photoconductive member 51. That is, since the resistive nature of the transfer nip is determinable from the transfer servo routine, a probable current change that is produced by a predetermined transfer voltage ramp is also determinable.

An appropriate transition from the image formation voltage to the non-print voltage may also improve the defect associated with the trailing edge 92 exiting the transfer nip 59 (See FIG. 6). Since the image formation voltage is generally higher than the non-image formation voltage, the types of ramps are different than those for addressing the leading edge 91 entering into the transfer nip 59. As illustrated in FIG. 6, the trailing edge 92 exiting the transfer nip 59 initially causes a negative current spike 306 that is followed by a positive current spike 307. Since lowering the transfer voltage causes negative transfer current spikes, it would be undesirable to do so while the media sheet 90 exiting the transfer nip 59 is already causing a negative current spike.

Figure 9:
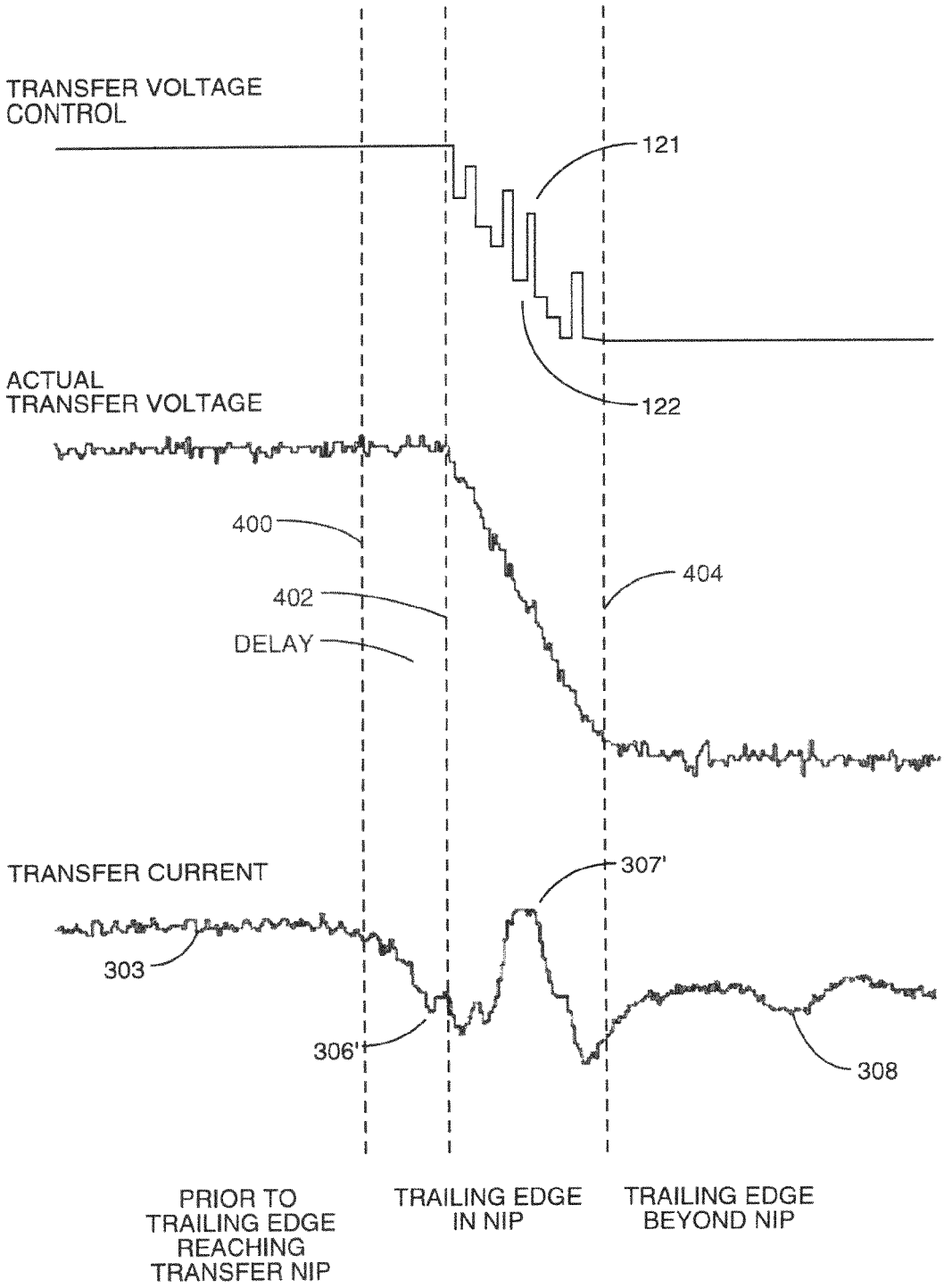
FIG. 9 illustrates a graph of the transfer voltage control and resulting transfer voltage and transfer current as a trailing edge of a media sheet approaches and passes through a transfer nip according to one embodiment.

FIG. 9 illustrates one embodiment of accommodating the exit of the trailing edge 92. The trailing edge 92 enters the nip at the first vertical dashed line 400. At this point, the transfer voltage control is held substantially constant for a period of time after the trailing edge 92 exits. This results in a negative spike 306' in the transfer current. After a delay corresponding to the timing of this negative spike 306', the transfer voltage is ramped down with alternating positive steps 121 and negative steps 122 to cancel or lessen the positive spike 307'. The transfer current then returns to a substantially constant level 308 after time 404 when the trailing edge 92 passes beyond the transfer nip 59.

Figure 10:
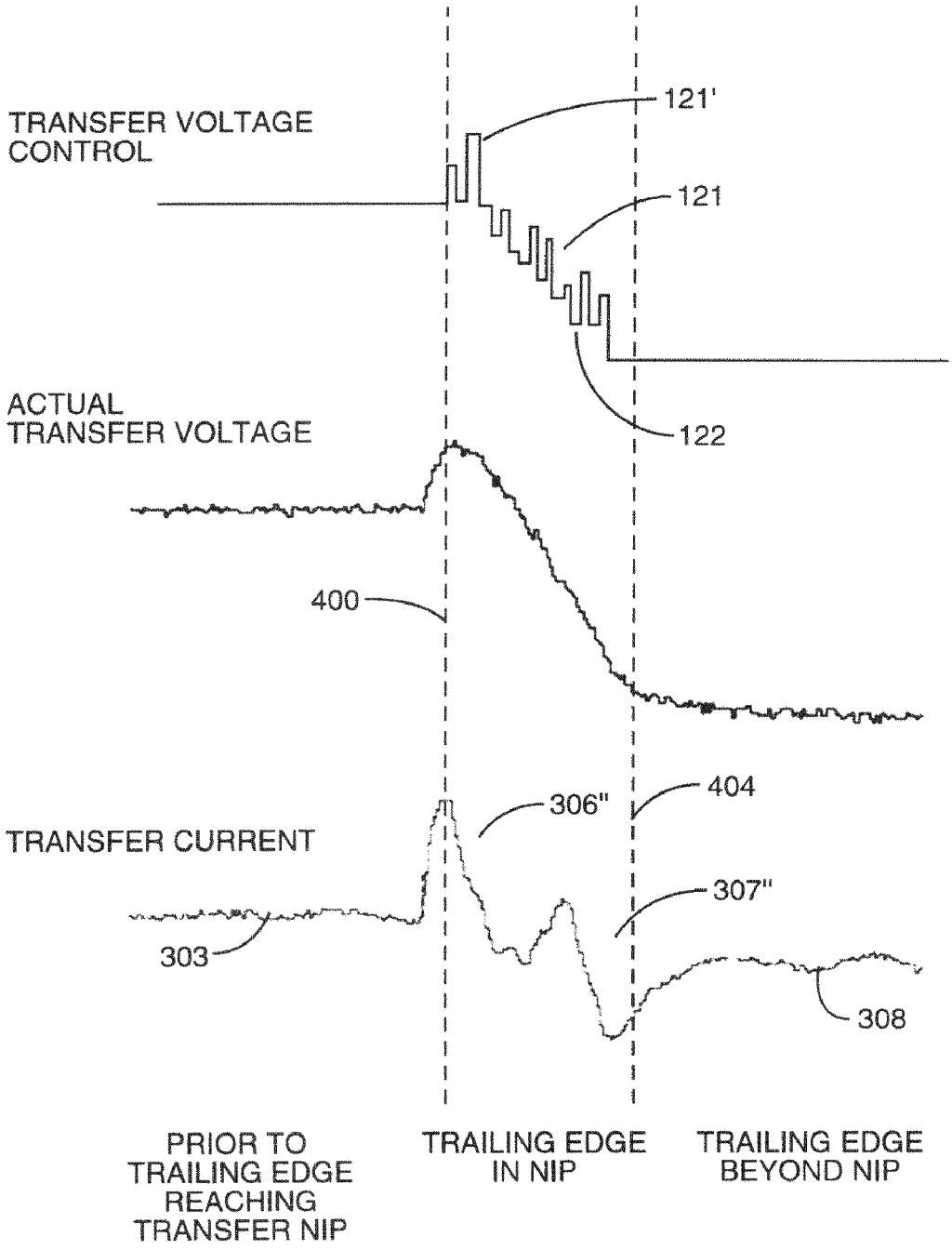
FIG. 10 illustrates a graph of the transfer voltage control and resulting transfer voltage and transfer current as a trailing edge of a media sheet approaches and passes through a transfer nip according to one embodiment.

FIG. 10 illustrates another approach that includes taking one positive step 121' as the trailing edge 92 enters the transfer nip 59 at time 400. The positive step 121' is implemented to cancel or reduce the negative spike (306 from FIG. 6) and produce a smaller negative spike or even a small positive spike 306". After this one positive step 121', the transfer voltage ramps down with alternating steps 121, 122 to limit the positive spike 307". Again, the transfer current returns to a substantially constant level 308 after time 404 when the trailing edge 92 passes beyond the transfer nip 59. As above, the sizes of the steps for treating the effects of the exiting trailing edge 92 may be determined by the differences in the print and non-print voltages and using the transfer servo voltage as described above.

Spatially relative terms such as "under", "below", "lower", "over upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of adjusting transfer voltage in an image forming device, the method comprising:

setting the transfer voltage at a first level;

when a leading edge of a media sheet enters into a transfer nip, increasing the transfer voltage in a series of alternating positive and negative steps; and after the leading edge of the media sheet passes through the transfer nip, setting the transfer voltage at a second level higher than the first level.

2. The method of claim 1, wherein the steps of setting the transfer voltage at the first level and setting the transfer voltage at the second level comprises setting the transfer voltages to be substantially constant.

3. The method of claim 1, wherein the step of increasing the transfer voltage in the series of alternating positive and negative steps comprises directly alternating between the positive and negative steps.

4. The method of claim 3, further comprising directly alternating between single positive and negative steps.

5. The method of claim 1, wherein the step of increasing the transfer voltage in the series of alternating positive and negative steps comprises generating multiple positive steps between multiple negative steps.

6. The method of claim 1, wherein the step of increasing the transfer voltage in the series of alternating positive and negative steps extends from the first level to the second level.

7. The method of claim 1, wherein the step of increasing the transfer voltage in the series of alternating positive and negative steps comprises increasing an amplitude of the alternating positive and negative steps.

8. The method of claim 1, wherein the step of increasing the transfer voltage in the series of alternating positive and negative steps comprises maintaining a substantially constant amplitude of the alternating positive and negative steps.

9. A method of adjusting transfer voltage in an image forming device, the method comprising:

setting the transfer voltage at a first level;

after a trailing edge of a media sheet enters into a transfer nip, decreasing the transfer voltage in a series of alternating positive and negative steps; and after the trailing edge of the media sheet passes through the transfer nip, setting the transfer voltage to a second level lower than the first level.

10. The method of claim 9, wherein the steps of setting the transfer voltage at the first level and setting the transfer voltage at the second level comprises setting the transfer voltages to be substantially constant.

11. The method of claim 9, wherein the step of decreasing the transfer voltage in the series of alternating positive and negative steps comprises directly alternating between the positive and negative steps.

12. The method of claim 11, further comprising directly alternating between single positive and negative steps.

13. The method of claim 9 wherein the step of decreasing the transfer voltage in the series of alternating positive and negative steps comprises generating multiple positive steps between multiple negative steps.

14. The method of claim 9, wherein the step of decreasing the transfer voltage in the series of alternating positive and negative steps extends from the first level to the second level.

15. The method of claim 9, wherein the step of decreasing the transfer voltage in the series of alternating positive and negative steps comprises increasing an amplitude of the alternating positive and negative steps.

16. The method of claim 9, wherein the step of decreasing the transfer voltage in the series of alternating positive and negative steps comprises maintaining a substantially constant amplitude of the alternating positive and negative steps.

17. The method of claim 9, further comprising generating an initial positive step when the trailing edge of the media sheet enters into the transfer nip.

18. A method of adjusting transfer voltage in an image forming device, the method comprising:

setting the transfer voltage at a first level;

upon a media sheet entering into and exiting from a transfer nip, changing the transfer voltage from the first level to a second level in a series of alternating positive and negative steps, the first level being different than the second level.

19. The method of claim 18 wherein the step of changing the transfer voltage from the first level to the second level in the series of alternating positive and negative steps comprises decreasing the transfer voltage when a trailing edge of the media sheet exits the transfer nip.

20. The method of claim 18 wherein the step of changing the transfer voltage from the first level to the second level in the series of alternating positive and negative steps comprises increasing the transfer voltage when a leading edge of the media sheet enters the transfer nip.

* * * * *